US005577959A

United States Patent [19]

Takemoto et al.

[11] Patent Number: 5,577,959

[45] Date of Patent: Nov. 26, 1996

[54] GAME APPARATUS AND GAME SYSTEM

[75] Inventors: Takatoshi Takemoto; Kazunari Kawashima, both of Tokyo, Japan

[73] Assignee: Kabushiki Kaisha Ace Denken, Japan

[21] Appl. No.: 256,163

[22] PCT Filed: Dec. 25, 1992

[86] PCT No.: PCT/JP92/01704

§ 371 Date: Jun. 23, 1994

§ 102(e) Date: Jun. 23, 1994

[87] PCT Pub. No.: WO93/12851

PCT Pub. Date: Jul. 8, 1993

[30] Foreign Application Priority Data

Dec. 25, 1991 [JP] Japan ..... 3-343692

[51] Int. Cl.[6] ..... G07F 17/32; A63F 7/02

[52] U.S. Cl. ..... 463/25; 463/29; 273/121 B

[58] Field of Search ..... 273/138 A, 143 R, 273/121 B; 364/412; 902/23; 463/25, 29, 16

[56] References Cited

U.S. PATENT DOCUMENTS 5,113,990 5/1992 Gabrius et al. ..... 273/138 A
5,179,517 1/1993 Sarbin et al. ..... 364/410

FOREIGN PATENT DOCUMENTS 125141 11/1978 Japan .
220679 9/1986 Japan .
268581 11/1987 Japan .
175880 7/1989 Japan .
156975 6/1990 Japan .
82491 8/1991 Japan .
WO91/02572 3/1991 WIPO .

*Primary Examiner*—Jessica J. Harrison
*Attorney, Agent, or Firm*—Andrus, Sceales, Starke & Sawall

[57] ABSTRACT

A game apparatus comprising a game machine main unit (30) for executing games with game play media in a tray and a game play media dispenser (20) responsive to a dispensing instruction for dispensing a specified number of game play media to the tray is disclosed. The game apparatus comprises a validator (26) for determining an amount of entered cash, means (60*a*) for subtracting a loan amount spent for a player to borrow game play media from the entered amount determined by the validator to find a remaining amount and managing the remaining amount, a loan switch (23) to specify a loan amount to be spent to borrow game play media, loan control means (62) for instructing the game play media dispenser to dispense game play media in a number corresponding to the loan amount specified with the loan switch within the range of the remaining amount managed by the remaining amount management means, and win control means (63) responsive to the winning signal output from the game machine main unit for a winning game play for instructing the game play media dispenser to dispense as many game play media as the number indicated by the winning signal.

20 Claims, 3 Drawing Sheets

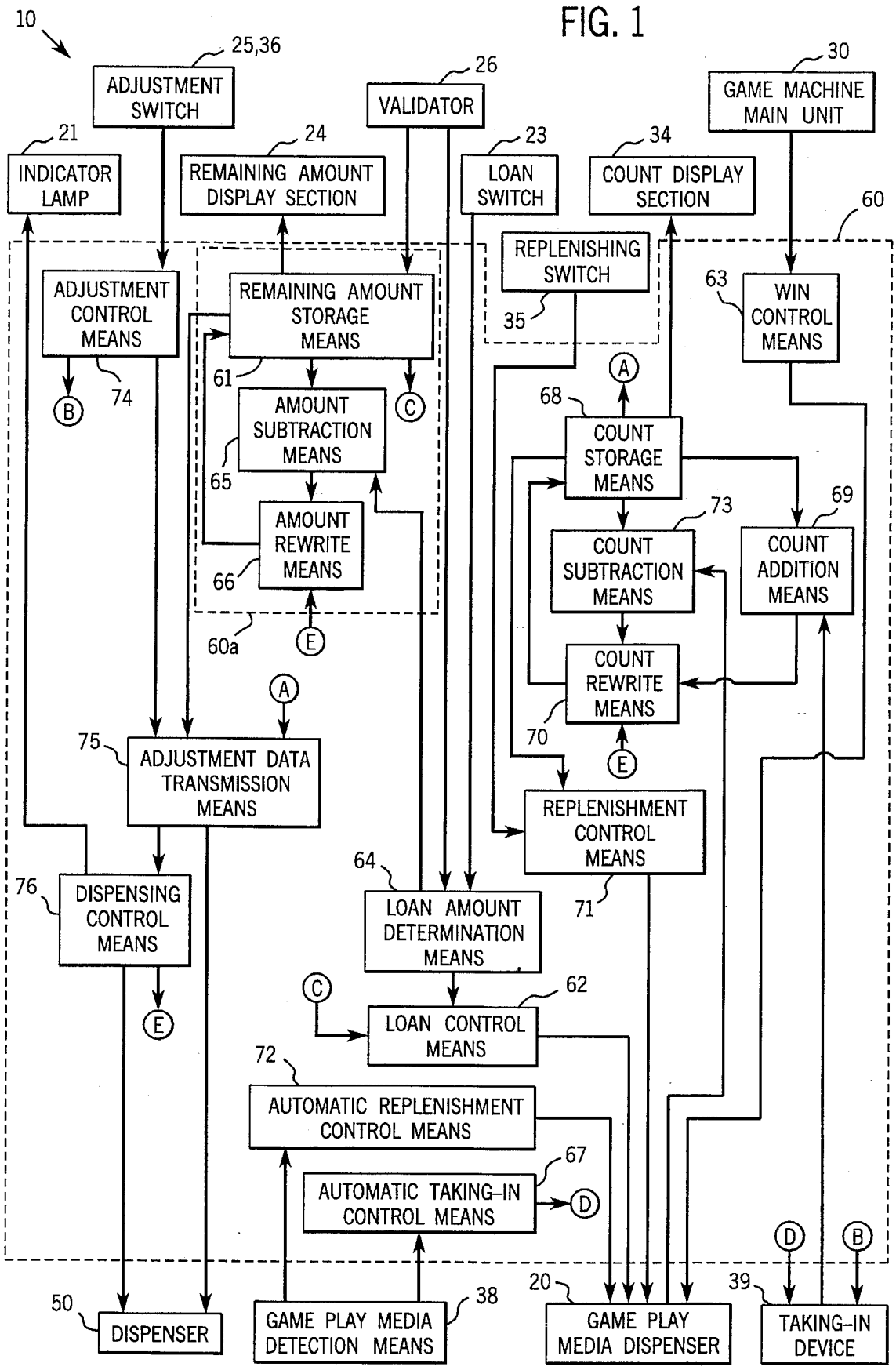
FIG. 1
10
25,36
ADJUSTMENT SWITCH
26
VALIDATOR
30
GAME MACHINE MAIN UNIT
21
INDICATOR LAMP
24
REMAINING AMOUNT DISPLAY SECTION
23
LOAN SWITCH
34
COUNT DISPLAY SECTION
60
REPLENISHING SWITCH
35
63
WIN CONTROL MEANS
ADJUSTMENT CONTROL MEANS
REMAINING AMOUNT STORAGE MEANS
61
74
B
C
AMOUNT SUBTRACTION MEANS
65
AMOUNT REWRITE MEANS
66
60a
E
A
68
COUNT STORAGE MEANS
73
69
COUNT SUBTRACTION MEANS
COUNT ADDITION MEANS
COUNT REWRITE MEANS
70
E
75
ADJUSTMENT DATA TRANSMISSION MEANS
REPLENISHMENT CONTROL MEANS
71
64
76
DISPENSING CONTROL MEANS
LOAN AMOUNT DETERMINATION MEANS
C
62
E
LOAN CONTROL MEANS
72
AUTOMATIC REPLENISHMENT CONTROL MEANS
67
AUTOMATIC TAKING-IN CONTROL MEANS
D
D
B
50
DISPENSER
GAME PLAY MEDIA DETECTION MEANS
38
20
GAME PLAY MEDIA DISPENSER
39
TAKING-IN DEVICE FIG. 3
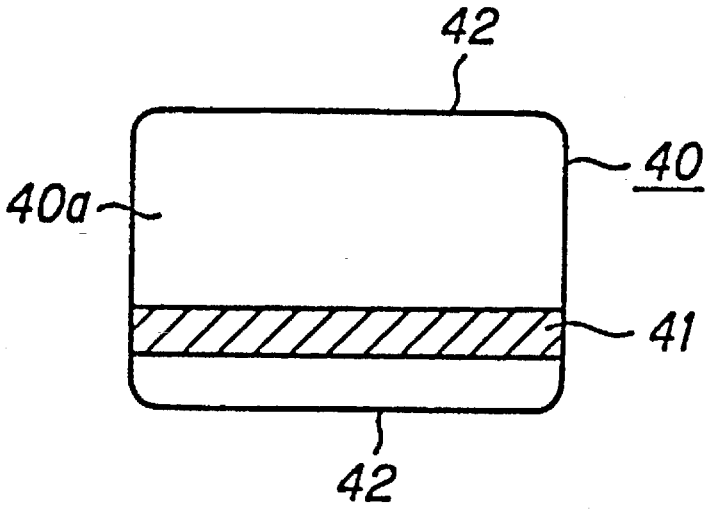
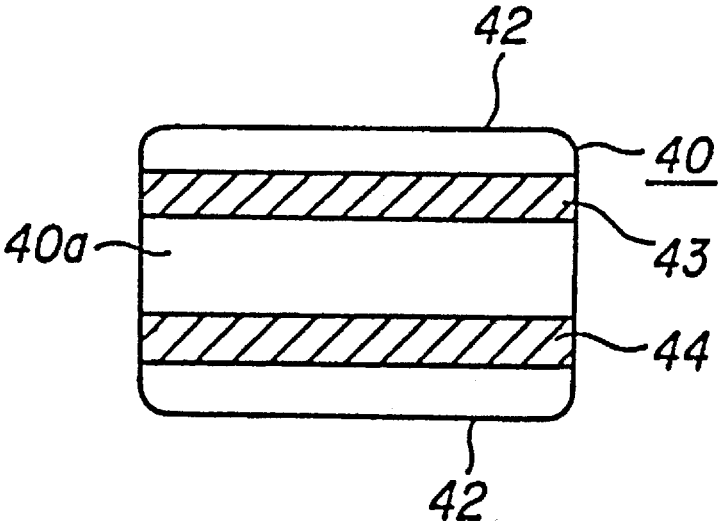
FIG. 4

GAME APPARATUS AND GAME SYSTEM

BACKGROUND OF THE INVENTION

1. Field of the Invention

This invention relates to a game apparatus and a game system, such as a slot machine, for a player to play games with game play media in a game play media tray and paying out prizes to the player for winning game plays.

2. Description of the Prior Art

With a conventional game machine and game play media lender, for example, a player inserts a prepaid card storing the amount of money into a slot of the game play media lender and operates a switch to borrow game play media. Then, the player places the game play media in the game play media tray of a game machine. In this condition, the player loads necessary game play media into the game machine so as to play a game. If the player satisfies a given condition in the process of the game, he or she wins the game and receives game play media for the winning game play from the game machine.

For adjustment, the player loads the paid-out game play media for winning game plays into a counter. The counter counts the number of the loaded game play media, prints the result on a receipt, and discharges the receipt to the outside. The player receives the receipt on which the count is recorded from the counter. He or she goes to a prize exchange counter or window for exchanging the receipt for prizes.

However, in the related art, the player first needs to purchase a prepaid card and from the beginning of a game to prize exchange, it requires time and effort for the player to receive game play media from the game play media lender and move them to the game play media tray of a game machine and finally to move paid-out game play media for winning game plays to the counter from the game play media tray.

SUMMARY OF THE PRESENT INVENTION

It is therefore an object of the invention to provide a game apparatus and a game system which enable a player to play games in the range of any desired amount of money if he or she enters a bill directly into the game apparatus and to save the player the trouble of purchasing a prepaid card and moving game play media received from a game play media lender to the game play media tray of a game machine, etc.

To these ends, according to one form of the invention, there is provided a game apparatus comprising a game machine main unit having a tray for holding media used to play games and executing games with the game play media in the tray and a game play media dispenser responsive to a dispensing instruction for dispensing a specified number of game play media to the tray, the game machine main unit outputting a winning signal to pay out game play media for a winning game play if a given condition is satisfied when a game is being played and the game play media dispenser being responsive to the signal for dispensing a given number of game play media, whereby game playing goes on, wherein the improvement comprises:

a validator having a slot for entering cash and determining an amount of cash entered through the slot;

means for subtracting a loan amount for a player to borrow game play media from the entered amount determined by the validator to find a remaining amount and managing the remaining amount;

a loan switch to specify a loan amount to be spent to borrow game play media;

loan control means for instructing the game play media dispenser to dispense game play media as much as the loan amount specified with the loan switch within the range of the remaining amount managed by the remaining amount management means; and win control means responsive to the winning signal output from the game machine main unit for a winning game play for instructing the game play media dispenser to dispense as many game play media as the number indicated by the winning signal.

The remaining amount management means can comprise:

means for storing the remaining amount found by subtracting a loan amount spent to borrow game play media from the entered amount determined by the validator; means for subtracting a loan amount corresponding to the number of game play media instructed to be dispensed by the loan control means from the amount stored in the remaining amount storage means; and means for rewriting the operation result of the amount subtraction means into the remaining amount storage means as a new remaining amount.

According to the invention, any of the following members can be added to the form whenever necessary:

First, it can further include means for determining that all entered amount is a loan amount if the validator does not determine that an entered denomination is a large denomination bill or for determining that an amount specified with the loan switch is a loan amount if the validator determines that the entered denomination is a large denomination bill, wherein the loan control means can instruct the game play media dispenser to dispense game play media in a number corresponding to the loan amount determined by the loan amount determination means within the range of the amount stored in the remaining amount storage means.

Second, it can further include a remaining amount display section for displaying the amount in the remaining amount storage means.

Third, it can further include:

a device for counting game play media in the tray and taking them inside the game apparatus; means for detecting the number of game play media in the tray; and automatic taking-in control means, if the game play media detection means determines that the number of game play media in the tray has exceeded a predetermined upper limit, for instructing the taking-in device to take in overflow game play media.

Fourth, it can further include:

count storage means for storing the number of game play media not contained in the tray and held in the game apparatus;

means for adding the number of game play media taken in by the taking-in device to a count in the count storage means; and means for rewriting the operation result of the count addition means into the count storage means as a new amount.

Fifth, it can further include:

a replenishing switch for specifying replenishment with a predetermined number of game play media; and replenishment control means, when the replenishing switch is handled, for instructing the game play media dispenser to dispense game play media specified by operating the replenishing switch within the range of the count in the count storage means.

Sixth, it can further include:

means for detecting the number of game play media in the tray; and automatic replenishment control means, if the game play media detection means determines that the number of game play media in the tray has fallen below a predetermined lower limit, for instructing the game play media dispenser to dispense game play media within the range of the count in the count storage means.

Seventhly, it can further include:

means for subtracting the number of game play media dispensed as instructed by the replenishment control means or the automatic replenishment control means from the count in the count storage means; and means for rewriting the operation result of the count subtraction means into the count storage means as a new amount.

Eighth, it can further include a count display section for displaying the count in the count storage means.

Ninth, it can further include:

an adjustment switch for specifying the end of game playing and making adjustment;

a dispenser for writing transferred remaining amount data and remaining count data onto a recording medium stored in the inside of the game apparatus in a predetermined format;

adjustment control means, when the adjustment switch is operated, for instructing the taking-in device to take in all game play media in the tray;

adjustment data transmission means, upon completion of taking in the game play media in response to the instruction of the adjustment control means, for reading the amount stored in the remaining amount storage means and the count stored in the count storage means and transmitting the read data to the dispenser as the remaining amount data and the remaining count data; and dispensing control means, after the data transmission by the adjustment data transmission means is completed, for instructing the dispenser to write the data onto the recording medium and dispense it.

In the form of the invention, the dispenser can write the data onto the recording medium by printing the data in a bar code as well as digits or characters.

Further, the dispenser writes the data onto the recording medium by printing the data in digits or characters and recording the same as magnetic data.

According to another form of the invention, there is provided a game system comprising a game apparatus having a game machine main unit having a tray for holding media used to play games and executing games with the game play media in the tray and a game play media dispenser responsive to a dispensing instruction for dispensing a specified number of game play media to the tray, the game machine main unit outputting a winning signal to pay out game play media for a winning game play if a given condition is satisfied when a game is being played and the game play media dispenser being responsive to the signal for dispensing a given number of game play media, whereby game playing goes on and a prize exchanger for paying out a prize in response to the number of game play media paid out as a winning game play.

As the game apparatus used with the game system, the game apparatus in the forms described above can be used.

At the game apparatus of the invention, when a bill is entered in the slot, the validator determines the denomination and amount of the bill, and the amount is stored in the remaining amount storage means as an initial value. Further, when a player operates the loan switch, the loan control means instructs the game play media dispenser to dispense game play media in a number corresponding to the loan amount specified by operating the loan switch within the range of the amount stored in the remaining amount storage means. Then, the game play media dispenser dispenses as many game play media as instructed to the tray.

The player plays games with the game play media in the tray. When the player wins a game and a winning signal is output from the game machine main unit, the win control means instructs the game play media dispenser to dispense as many game play media as indicated by the winning signal. Then, the game play media dispenser dispenses as many game play media as instructed to the tray.

Thus, the player can play games in the range of any desired amount of money if he or she enters a bill directly into the game apparatus. Therefore, the game apparatus saves the player the trouble of purchasing a prepaid card and moving game play media received from a game play media lender to the game play media tray of a game machine, etc.

Further, if the loan amount determination means is provided, when the denomination of the entered bill is not a large denomination bill, in response to the determination result of the validator, the loan amount determination means determines that all the entered amount is the loan amount; when the entered bill denomination is a large denomination bill, the loan amount determination means determines that the amount specified with the loan switch is the loan amount. The game play media dispenser automatically dispenses game play media in a number corresponding to the loan amount. Thus, when entered cash is small denomination such as coins and the loan amount need not be set, game play media in a number corresponding to the entered amount of money are automatically dispensed if the player does not operate their loan switch.

If the amount subtraction means and the amount rewrite means are provided, the amount subtraction means subtracts the loan amount by as much as the game play media instructed to be dispensed by the loan control means from the amount stored in the remaining amount storage means, and the amount rewrite means rewrites the operation amount of the amount subtraction means into the remaining amount storage means as a new remaining amount. Thus, the remainder of the entered amount not used to borrow game play media is always stored inside the game apparatus; it is convenient for later adjustment, etc.

When the remaining amount display section is contained, it displays the amount in the remaining amount storage means, namely, the remaining amount, thus the player can play games while always checking the remaining amount.

If the taking-in device, the game play media detection means, and the automatic taking-in control means are provided, when the game play media detection means determines that the number of game play media in the tray exceeds a predetermined upper limit, the automatic taking-in control means instructs the overflow game play media to be taken in and the taking-in device counts the overflow game play media and takes them inside the game apparatus. Thus, if a large number of game play media are paid out to the tray for winning game plays, the game play media do not overflow from the tray and are automatically taken in; this saves the player the trouble of taking out game play media ready to overflow during game playing.

If the count storage means, the count addition means, and the count rewrite means are provided, each time the game play media in the tray are taken in by the taking-in device, the number of the game play media is added by the count addition means to the count in the count storage means for registration; it is convenient for later adjustment, etc.

If the replenishing switch and the replenishment control means are included, when the player handles the replenishing switch, the replenishment control means instructs the game play media dispenser to dispense a predetermined number of game play media specified by operation of the replenishing switch within the range of the count in the count storage means. Then, the game play media dispenser dispenses as many game play media as the predetermined number to the tray. Thus, when the player has only a few game play media left in the tray during the progress of game playing while he or she continues to lose games, the player can operate the replenishing switch easily to dispense game play media to the tray in the range of the number of the game play media taken in so far and continue playing.

If the game play media detection means and the automatic replenishment control means are provided, when the game play media detection means detects that only a few game play media are left in the tray, the tray is automatically replenished with game play media so long as the taken-in game play media are held in the game machine. Thus, the player can also enjoy playing until he or she depletes his or her game play media by as much as the entered amount and those paid out for winning game plays without taking care of the number of game play media in the tray.

If the count subtraction means and the count rewrite means are included, the count subtraction means subtracts the number of game play media dispensed in response to the instruction of the replenishment control means or the automatic replenishment control means from the count in the count storage means, the count rewrite means rewrites the operation result of the count subtraction means into the count storage means as new contents. That is, the most recent number of game play media not dispensed to the tray and held in the game apparatus is always registered in the count storage means; it is convenient for later adjustment and prize exchange:.

If the count display section is provided, it displays the new count stored in the count storage means, namely, the most recent number of game play media not dispensed to the tray and held in the game apparatus. The player can play games while always checking the number of game play media held in the game apparatus.

If the adjustment switch, the dispenser, the adjustment control means, the adjustment data transmission means, and the dispensing control means are provided, the adjustment control means is responsive to an instruction given by the user operating the adjustment switch to instruct the taking-in device to take in all game play media in the tray. Upon completion of taking in all game play media in response to the instruction of the adjustment control means, the adjustment data transmission means reads the amount stored in the remaining amount storage means and the count stored in the count storage means and transmits the data to the dispenser as the remaining amount data and the remaining count data. Upon completion of the data transmission by the adjustment data transmission means, the dispensing control means sends an instruction to the dispenser. When receiving it, the dispenser writes the received remaining amount data and remaining count data onto a card-like recording medium stored inside in a predetermined format and dispenses it. Thus, to end playing games, if the player only operates the adjustment switch, the recording medium on which information of the remaining count and the remaining number of game play media is registered is automatically dispensed and adjustment or prize exchange can be made without the time or effort of taking out game play medium from the tray and inputting them to the counter, etc.

If the dispenser writes data onto the recording medium by printing a bar code as well as digits or characters, personnel in the game house or the player can check the data at a glance from the digits or characters and the data can also be easily input to a POS terminal or the like through a bar code reader.

When the dispenser writes the data onto the recording medium by recording it as magnetic data, the data can also be easily input through a magnetic card reader or the like.

With the game system comprising the prize exchanger for reading the remaining amount data or remaining count data on the recording medium and returning the remaining amount of money and paying out a prize in response to the remaining count, the prize exchanger eliminates the need for personnel in the game house to pay out a prize desired by the player as instructed by the player.

BRIEF DESCRIPTION OF THE DRAWINGS

In the accompanying drawings:

FIG. 1 is a functional block diagram of a game apparatus showing one embodiment of the invention;

FIG. 3 is a front view of a recording medium showing the embodiment of the invention; and FIG. 4 is a front view of a recording medium showing another embodiment of the invention.

BEST MODE FOR CARRYING OUT THE INVENTION

Figure 2:
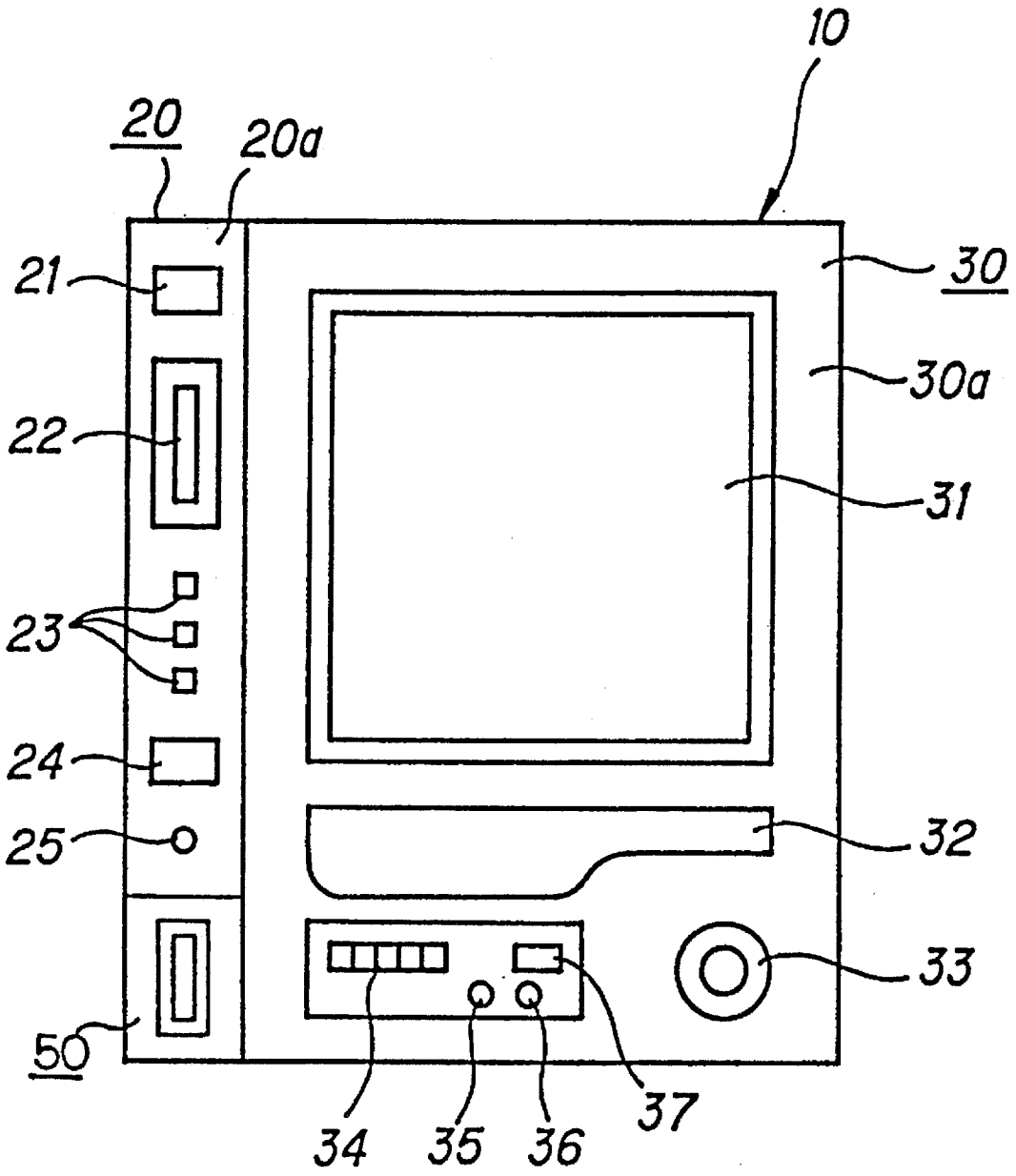
FIG. 2 is a front view of the game apparatus showing the embodiment of the invention.

Referring now to the accompanying drawings of FIGS. 1–4, there is shown one embodiment of the invention.

A game apparatus 10 comprises a game play media dispenser 20, a game machine main unit 30, and a dispenser of storage media for adjustment, 50, as shown in FIG. 2, and further contains an internal control section 60 as shown in FIG. 1. A slot machine is built in as the game machine main unit 30. Handled as the game play media are those used with the game machine main unit 30, such as medals, chips, or balls. In addition, another game machine such as a pinball machine may be built in as the game machine main unit 30.

The recording medium 40 handled at the dispenser 50 is a card made of a rectangular plate, as shown in FIG. 3 or 4, and has one side 40*a* consisting of a portion in which entries such as the remaining amount of money, the number of held game play media, the date, and the game house name are made and a recording portion 41 or portions 43 and 44 where these information entries are registered. In the example, the recording portion 41 is made of a magnetic recording band formed along one of long sides 42, as shown in FIG. 3. The recording portion 41 may be made of a bar code.

The recording medium 40 may be enabled to be recycled by using a medium on which the information entries are printed in ink erased by irradiation with light of a predetermined frequency or a medium having a surface on which characters, etc., can be written and erased as desired by applying predetermined heat.

The game play media dispenser 20 is adapted to dispense a specified number of game play media by the control section 60 to a tray 32 (described below). It has an indicator lamp 21, a slot 22, loan switches 23, a remaining amount display section 24, and an adjustment switch 25 on the front 20*a*, as shown in FIG. 2.

The slot 22 is provided to enter cash of bills or coins. A validator 26 (shown in FIG. 1) for identifying the denomination and amount of entered money is disposed in the inside of the slot 22, and the determination results of the denomination and amount of cash entered through the slot 22 are sent to the control section 60. In FIG. 2, the slot 22 is drawn as a double rectangle, but separate slots for bills and coins may be located. In the embodiment, the slot 22 is arranged so that a player can enter a bill upright, thereby contributing to decreasing the thickness of the game play media dispenser 20.

The loan switches 23 are switches for specifying the loan amount to be spent to borrow game play media; in the example, the switches 23 are pushbutton switches corresponding to the digits representing predetermined amounts of money, such as 100, 500, and 1000, which correspond to the denominations of coins, 100, 500, and 1000 yen. The loan switches 23 may be made one pushbutton for 1000 yen, for example.

The game machine main unit 30 has on its front 30*a* a board face 31, which is an area for playing games, a tray 32 of game play media, a handle 33 for loading game play media into the game machine, a count display section 34 for displaying the number of held game play media not dispensed to the tray 32, a replenishing switch 35 for instructing the tray 32 to be replenished with game play media, an adjustment switch 36 for instructing adjustment to be made at the end of plays, and a closed indicator lamp 37 for indicating that the game machine is locked up on a win. When game play media in the tray 32 are loaded into the game machine main unit 30, the game machine main unit 30 executes games, and if the player satisfies a given condition, gives a prize to the player as a winning game play. When a winning game play occurs, the game machine main unit outputs a winning signal to the control section 60.

The board face 31 is designed to enable the player to see the progress of a game with game play media. The tray 32 is disposed to store game play media to be propelled toward the board face 31. The tray 32 is provided with game play media detection means 38 for detecting the number of game play media in the tray 32 and a taking-in device 39 (shown in FIG. 1) responsive to a command of the control section 60 for counting a specified number of game play media in the tray 32 and taking them into the inside of the game apparatus. The taking-in device 39 may be adapted to automatically take game play media overflowing from the tray 32 into the inside of the game apparatus independently of detection of the game play media detection means 38.

The handle 33 is used for the player to propel game play media in the tray 32 toward the board face 31. The count display section 34 is responsive to a signal from the control section 60 for displaying the number of held game play media not dispensed to the tray 32, namely, the number of game play media with which the tray 32 can be replenished. The replenishing switch 35 is a switch for instructing the control section 60 to replenish the tray 32 with game play media. The closed indicator lamp 37 goes on to inform the player that the game machine is locked up on a win.

The dispenser 50 is responsive to a command of the control section 60 for printing the remaining amount of money, the remaining number of game play media, etc., on a recording medium 40 stored in the inside and registering the information pieces in the recording section 41 or 43, 44 as magnetic data. The dispenser 50 may be adapted to print the information pieces as a bar code.

The control section 60 consists of a computer system, for example. The hardware of the computer system has a general configuration (not shown) consisting of a central processing unit (CPU), memory, interface, etc. The memory stores CPU operation programs, data, etc. The CPU executes the programs for providing various functions. The functional components provided by the CPU include means for managing the remaining amount of money, 60*a*, loan control means 62, win control means 63, loan amount determination means 64, automatic taking-in control means 67, count storage means 68, count addition means 69, count rewrite means 70 (addition count rewrite means, subtraction count rewrite means), replenishment control means 71, automatic replenishment control means 72, count subtraction means 73, adjustment control means 74, adjustment data transmission means 75, and dispensing control means 76.

The means for managing the remaining amount of money, 60*a*, which has remaining amount storage means 61, amount subtraction means 65, and amount rewrite means 66, subtracts the loan amount spent to borrow game play media from the entered amount of money determined by the validator to find the remaining amount of money and manages the remaining amount.

The remaining amount storage means 61 is a memory for storing the entered amount of money determined by the validator 26 as an initial value. The loan control means 62 instructs the game play media dispenser 20 to dispense game play media in a number corresponding to the loan amount within the range of the amount stored in the remaining amount storage means 61. The win control means 63 is responsive to a winning signal output from the game machine main unit 30 for a winning game play for instructing the game play media dispenser 20 to dispense as many game play media as the number indicated by the winning signal.

In the embodiment, after the remaining amount of money reaches 0, the player enters another bill. However, it is also made possible to enable the user to enter an additional bill before the remaining amount of money reaches 0. To do this, the amount of money from the validator 26 is added to the amount of money stored in the remaining amount storage means 61 and the sum is written into the remaining amount storage means 61.

If the validator 26 does not determine that the entered denomination is, a large denomination bill, such as a 5000-yen or 10000-yen bill, the loan amount determination means 64 determines that all the entered amount is the loan amount; if the validator 26 determines that the entered denomination is a large denomination bill, the loan amount determination means 64 determines that the amount specified with the loan switch 23 is the loan amount.

The amount subtraction means 65 subtracts the loan amount corresponding to the game play media instructed to be dispensed by the loan control means 62 from the amount stored in the remaining amount storage means 61. The amount rewrite means 66 rewrites the operation result of the amount subtraction means 65 into the remaining amount storage means 61 as a new remaining amount.

When the game play media detection means 38 determines that the number of game play media in the tray 32 has exceeded a predetermined upper limit, the automatic taking-in control means 67 instructs the taking-in device 39 to take in the overflow game play media.

The count storage means 68 stores the number of game play media not in the tray 32 and held in the game machine. The count addition means 69 adds the number of game play media taken into the game machine by the taking-in device 39 to the count in the count storage means 68. The count rewrite means 70 rewrites the operation result of the count addition means 69 or the count subtraction means 73 into the count storage means 68 as a new count.

When the replenishing switch 35 is operated, the replenishment control means 71 checks to ensure that the predetermined number of game play media specified with the replenishing switch 35 is within the range of the count in the count storage means 68, then instructs the game play media dispenser 20 to dispense a predetermined number of game play media as specified with the replenishing switch 35.

When the game play media detection means 38 determines that the number of game play media in the tray 32 has fallen below a predetermined lower limit, the automatic replenishment control means 72 instructs the game play media dispenser 20 to dispense the game play media within the range of the count in the count storage means 68.

Various techniques as well as the technique of supplying game play media to the tray can be adopted as means for replenishing with game play media: Game play media may be automatically supplied within the game machine or control is performed so as to continue playing games electrically.

The count subtraction means 73 subtracts the number of game play media dispensed in response to an instruction of the replenishment control means 71 or the automatic replenishment control means 72 from the count in the count storage means 68.

When the adjustment switch 25 or 36 is operated, the adjustment control means 74 instructs the taking-in device 39 to take in all the game play media in the tray 32. Upon completion of taking in the game play media in response to the instruction of the adjustment control means 74, namely, when the count addition means 69 stops counting for several seconds or longer, the adjustment data transmission means 75 reads the amount stored in the remaining amount storage means 61 and the count stored in the count storage means 68 and transmits the read data to the dispenser 50 as the remaining amount data and the remaining count data.

After the data transmission by the adjustment data transmission means 75 is completed, the dispensing control means instructs the dispenser 50 to write the data onto a recording medium 40 and dispense it. Within several seconds of the recording medium 40 being dispensed, the dispensing control means 76 signals the amount rewrite means 66 or the count rewrite means 70 to reset the contents of the remaining amount storage means 61 and the count storage means 68 for displaying zero on the remaining amount display section 24 and the count display section 34. However, if both the amount stored in the remaining amount storage means 61 and the count stored in the count storage means 68 are zero, the dispensing control means 76 does not instruct the dispenser 50 to dispense the recording medium 40 and causes the indicator lamp 21 to blink or go on for indicating the end of game play.

The configuration of the game apparatus 10 has been discussed. If the game apparatus 10 is combined with a prize exchanger (not shown) for reading the remaining amount data or remaining count data on the recording medium 40 and returning the remaining amount of money to the player and paying out a prize to the player in response to the remaining count, a game system according to one embodiment of the invention is provided. The system of the prize exchanger is described below.

Next, the operation of the game apparatus will be described.

At the game apparatus 10, when a bill is entered in the slot 22, the validator 26 determines the denomination and amount of the bill, and the amount is stored in the remaining amount storage means 61 as an initial value. When the denomination of the entered bill is not a large denomination bill, in response to the determination result of the validator, the loan amount determination means 64 determines that all the entered amount is the loan amount; when the entered bill denomination is a large denomination bill, the loan amount determination means 64 determines that the amount specified with the loan switch is the loan amount.

The loan control means 62 checks to ensure that the loan amount is within the range of the amount stored in the remaining amount storage means 61, then instructs the game play media dispenser 20 to dispense game play media in a number corresponding to the loan amount determined by the loan amount determination means 64. Then, the game play media dispenser 20 dispenses as many game play media as instructed to the tray 32.

That is, when the entered bill is a large denomination bill, such as a 5000-yen bill, a wait is made for a player to operate the loan switch 23. When the player operates the loan switch 23, game play media in a number corresponding to the amount specified by operating the loan switch are dispensed. If the amount of money entered is a coin, etc., game play media in a number corresponding to the entered amount of money are automatically dispensed regardless of how the loan switch 23 is operated.

The player plays games with the game play media in the tray 32. When the player wins a game and a winning signal is output from the game machine main unit 30, the win control means 63 instructs the game play media dispenser 20 to dispense as many game play media as indicated by the winning signal. Then, the game play media dispenser 20 dispenses as many game play media as instructed to the tray 32.

When the loan control means 62 instructs game play media to be dispensed, the amount subtraction means 65 subtracts the loan amount specified by the loan control means 62 from the amount stored in the remaining amount storage means 61, and the amount rewrite means 66 rewrites the operation amount of the amount subtraction means into the remaining amount storage means 61 as a new remaining amount, which is then displayed on the remaining amount display section 24.

If the player wins games repeatedly during playing and the number of game play media in the tray 32 exceeds a predetermined upper limit and when the game play media detection means 38 detects it, the automatic taking-in control means 67 instructs the overflow game play media to be taken in and the taking-in device 39 counts the overflow game play media and takes them inside the game apparatus. Each time the game play media are taken in by the taking-in device 39, the number of game play media is added by the count addition means 69 to the count in the count storage means 68 for registration.

If the player operates the replenishing switch 35 during game playing, the replenishment control means 71 instructs the game play media dispenser 20 to dispense a predetermined number of game play media specified within the range of the count in the count storage means 68. Then, the game play media dispenser dispenses as many game play media as the predetermined number to the tray 32.

Even if the player does not operate the replenishing switch 35, when the number of game play media in the tray 32 falls below a predetermined lower limit, the game play media detection means 38 detects it and the automatic replenishment control means 72 automatically replenishes the tray with game play media so long as the taken-in game play media are held.

When the held game play media are thus dispensed, the count subtraction means 73 subtracts the number of game play media dispensed in response to the instruction of the replenishment control means 71 or the automatic replenishment control means 72 from the count in the count storage means, the count rewrite means 70 rewrites the operation result of the count subtraction means 73 into the count storage means 68 as new contents, and the count display section 34 displays the new count in the count storage means 68, namely, the most recent number of game play media not dispensed to the tray and held in the game apparatus.

If the player operates the adjustment switch 25 or 36 at the end of game playing, the adjustment control means 74 instructs the taking-in device 39 to take in all game play media in the tray 32. Upon completion of taking in all game play media in response to the instruction of the adjustment control means 74, the adjustment data transmission means 75 reads the amount stored in the remaining amount storage means 61 and the count stored in the count storage means 68 and transmits the data to the dispenser 50 as the remaining amount data and the remaining count data.

Upon completion of the data transmission by the adjustment data transmission means 75, the dispensing control means 76 sends the remaining amount data and the remaining count data together with a dispensing instruction to the dispenser 50. When receiving them, the dispenser 50 writes the remaining amount data and the remaining count data onto a card-like recording medium 40 stored inside in a predetermined format and dispenses it. When both the amount stored in the remaining amount storage means 61 and the count stored in the count storage means 68 are zero, the recording medium 40 is not dispensed and the indicator lamp 21 blinks or goes on, to indicate the end of game play under the control of the dispensing control means 76.

If the player takes the dispensed recording medium 40 and goes to the prize exchanger where the player inputs data on the recording medium 40 and performs predetermined operations, a prize and the remaining amount of money are paid out to the player.

Thus, according to the game apparatus and the game system, if the player enters a bill directly in the game apparatus and operates the loan switch 23, he or she can start playing a game within the range of any desired amount while checking the remaining amount; this saves the player the trouble of purchasing a prepaid card or receiving game play media from a game play media lender and moving them to the game play media tray of a game machine, etc. Moreover, when entered cash is a small denomination such as coins and the loan amount need not be set, operating of the loan switch 35 is not required.

If a large number of game play media are paid out to the tray 32 for winning game plays during game playing, the game play media do not overflow from the tray 32 and are automatically taken in; this saves the player the trouble of taking out game play media ready to overflow during game playing.

When the player has only a few game play media left in the tray 32 during the progress of game playing while he or she continues to lose games, the player can operate the replenishing switch 35 to dispense game play media to the tray 32 in the range of the number of the game play media taken in so far and continue playing while checking the number of the game play media held in the game apparatus. If the player simply continues playing without performing such operations, he or she can also enjoy playing until the player runs through his or her game play media by as much as the loan amount and those paid out for winning game plays.

If the player only operates the adjustment switch 25 or 36 at the end of game playing, a recording medium 40 on which information of the remaining amount and the remaining number of game play media is registered is automatically dispensed; this saves the player the trouble of taking out game play media from the tray 32 and inputting them to the counter.

The recording medium 40 enables personnel in the game house or the player to check the data at a glance from the digits or characters printed on the surface of the recording medium 40 and also enables the data to be easily input to the prize exchanger (POS terminal) through a magnetic card reader or a bar code reader.

The recording medium 40 may be a receipt of thermosensible type.

Prize exchange or return of the remaining money is automatically performed by the prize exchanger, eliminating the need for personnel in the game house to pay out a prize desired by the player as instructed by the player.

The prize exchanger may be designed so as to perform an adjustment process such as paying out a prize and returning the remaining money as described below.

The prize exchanger first reads data on a recording medium (card) inserted by a player (customer) or personnel in the game house. If the date or the like differs from the correct one, a message such as "invalid date" is output by means of an alarm display or electronic sound, etc., and the card is automatically rejected.

Next, the remaining money is returned based on the read data. To do this, bills for returning the remaining money (1000- yen bills) set in a remaining money return section are automatically counted and output to the dispensing slot so that personnel in the game house check and hand the remaining money to the customer or the customer receives the remaining money directly.

Next, a prize exchange process is performed in response to the number of game play media paid out to the player. When the number of the game play media reaches zero, the process is terminated. When a remainder occurs in the number of game play media, a small prize corresponding to the remainder is paid out or the remainder is discarded. The remainder can also be handled as described below.

For example, a card where the remainder is entered is delivered to the customer. The customer collects several remainder cards to a given count of the remainders for exchanging the cards for a prize. In this case, one remainder card may be given to one customer so that at each prize exchange, a new remainder is added to the count on the remainder card for recording and the card is delivered to the customer.

Alternatively, a card as a membership card is issued instead of the remainder card and the remainders are stored in a computer in the game house together with the membership number, or a point indication system rather than recording the remainders of game play media may be adopted in which a given number of points collected can be exchanged for a prize.

In the embodiment, for loaning, replenishing, or paying out for winning game plays, game play media are always once dispensed to the tray, but the invention is not limited to such a system. For example, when the number of game play media in the tray exceeds a predetermined count (game play media overflow from the tray), game play media are not actually dispensed or taken in, and when a winning game play occurs, for example, internal data (data in the count storage means) or display (display on the count display section) may be counted up as if game play media were paid out for the winning game play.

Such a system does not provide a dynamic stage effect using a discharge sound of game play media, but has an advantage of eliminating the movement of extra game play media. For the method of replenishing with game play media for the system, the technical concept proposed by the applicant in Japanese Patent Application No. Hei 1-220938 can be used.

We claim:

1. A game apparatus having a game machine main unit for executing games with game play media comprising:

a game play media dispenser responsive to a dispensing instruction for dispensing a specified number of game play media outside said game apparatus;

a validator having a slot for receiving a currency denominated bill and determining the amount of the denomination of the bill received through the slot;

a loan switch to specify a loan amount to be spent to borrow game play media;

means for determining that all of said received amount is a loan amount if said validator does not determine that the denomination of a received bill is greater than a predetermined amount while determining that an amount specified with said loan switch is a loan amount if said validator determines that the denomination of a received bill is greater than a predetermined amount; and loan control means for instructing said game play media dispenser to dispense game play media in a number corresponding to the loan amount determined by said loan amount determination means.

2. The game apparatus as claimed in claim 1 further including:

remaining amount management means for managing a remaining amount, said remaining amount management means subtracting a loan amount of game play media from the received amount determined by said validator to obtain said remaining amount, said loan control means for instructing said game play media dispenser to dispense game play media in a number corresponding to the loan amount determined by said loan amount determination means within the limit of the remaining amount managed by said remaining amount management means.

3. The game apparatus as claimed in claim 2 wherein said remaining amount management means comprises:

means for storing the remaining amount obtained by subtracting a loan amount spent to borrow game play media from the received amount determined by said validator;

means for subtracting a loan amount corresponding to a number of game play media instructed to be dispensed by said loan control means from the amount stored in said remaining amount storage means; and means for rewriting an operation result of said amount subtraction means into said remaining amount storage means as a new remaining amount.

4. The game apparatus as claimed in claim 3 further including:

a tray for holding game play media to be used for playing games, said game machine main unit executing games with the game play media in said tray and outputting a winning signal to pay out game play media for a winning game play if a given condition is satisfied when a game is being played.

5. The game apparatus as claimed in claim 4 further including:

win control means responsive to the winning signal output from said game machine main unit for a winning game play for instructing said game play media dispenser to dispense as many game play media as the number indicated by the winning signal.

6. The game apparatus as claimed in claim 5 further including:

a remaining amount display section for displaying the amount in said remaining amount storage means.

7. The game apparatus as claimed in claim 4 further including:

a device for counting game play media in said tray and taking the game play media into said game apparatus;

means for detecting the amount of game play media in said tray; and automatic taking-in control means for instructing said taking-in device to take in overflowing game play media, if said game play media detection means determines that the amount of the game play media in said tray has exceeded a predetermined upper limit.

8. The game apparatus as claimed in claim 7 further including:

count storage means for storing the number of game play media not contained in said tray and held in said game apparatus;

means for adding the number of game play media taken in by said taking-in device to a count stored in said count storage means; and means for rewriting an operation result of said count addition means into said count storage means as a new count.

9. The game apparatus as claimed in claim 8 further including:

means for instructing said game play media dispenser to dispense game play media to said tray;

means for subtracting the number of game play media dispensed in response to the instruction of said means from the count in said count storage means; and means for rewriting an operation result of said count subtraction means into said count storage means as a new count.

10. The game apparatus as claimed in claim 9 wherein said means for instructing game play media to be dispensed for replenishing said tray comprises:

a replenishing switch for specifying replenishment with a predetermined number of game play media; and replenishment control means for instructing said game play media dispenser to dispense game play media specified by operation of said replenishing switch within the range of the count in said count storage means, when said replenishing switch is operated.

11. The game apparatus as claimed in claim 9 wherein said means for instructing game play media to be dispensed for replenishing said tray comprises:

means for detecting the number of game play media in said tray; and replenishment control means for instructing said game play media dispenser to dispense game play media within the range of the count in said count storage means, if said game play media detection means determines that the number of game play media in said tray has fallen below a predetermined lower limit.

12. The game apparatus as claimed in claim 11 further including:

a count display section for displaying the count stored in said count storage means.

13. The game apparatus as claimed in claim 12 further including:

a dispenser for recording, upon receipt of information of the remaining amount managed by said remaining amount management means at the end of game playing, the information on a provided recording medium and dispensing the recording medium;

an adjustment switch for specifying the end of game playing and an adjustment;

adjustment control means for instructing said taking-in device to take in all game play media in said tray, when said adjustment switch is operated;

adjustment data transmission means for reading the amount stored in said remaining amount storage means and the count stored in said count storage means and transmitting the read data to said dispenser as the remaining amount data and the remaining count data, upon completion of taking in the game play media in response to the instruction of said adjustment control means; and dispensing control means for instructing said dispenser to write the data onto the recording medium and dispense the recording medium, after the data transmission by said adjustment data transmission means is completed, said dispenser for writing the remaining amount data and the remaining count data onto the recording medium and dispensing the recording medium.

14. The game apparatus as claimed in claim 13 wherein said dispenser includes a printer for printing the data in a bar code as well as for writing digits or characters of data onto the recording medium.

15. The game apparatus as claimed in claim 13 wherein said dispenser includes a printer for printing the data in digits or characters and recording the data as magnetic data onto the recording medium.

16. In a game system comprising a plurality of game apparatuses and a prize exchanger, said game apparatuses executing games with game play media, said price exchanger paying out a prize to a player in response to the number of game play media paid out to the player as a winning game play, said plurality of game apparatuses each comprising:

a game machine main unit having a tray for holding game play media to be used for playing games and executing games with the game play media in said tray, said game machine main unit outputting a winning signal to pay out game play media for a winning game play if a given condition is satisfied when a game is being played;

a game play media dispenser responsive to a dispensing instruction for dispensing a specified number of game play media to said tray;

a validator having a slot for receiving a currency denominated bill and determining the amount of the denomination of the bill received through the slot;

a loan switch to specify a loan amount to be spent to borrow game play media;

means for determining that all of said received amount is a loan amount if said validator does not determine that the denomination of a received bill is greater than a predetermined amount while determining that an amount specified with said loan switch is a loan amount if said validator determines that the denomination of a received bill is greater than a predetermined amount;

remaining amount management means for managing a remaining amount, said remaining amount management means subtracting a loan amount of game play media from the received amount determined by said validator to obtain a remaining amount;

loan control means for instructing said game play media dispenser to dispense game play media in a number corresponding to the loan amount determined by said loan amount determination means within the limit of the remaining amount managed by said remaining amount management means; and win control means responsive to the winning signal output from said game machine main unit for a winning game play for instructing said game play media dispenser to dispense as many game play media as the number indicated by the winning signal, said remaining amount management means comprising:

means for storing the remaining amount obtained by subtracting a loan amount spent to borrow game play media from the received amount determined by said validator;

means for subtracting a loan amount corresponding to a number of game play media instructed to be dispensed by said loan control means from the amount stored in said remaining amount storage means; and means for rewriting an operation result of said amount substraction means into said remaining amount storage means as a new remaining amount, said game apparatus further including:

a device for counting game play media in said tray and taking the game play media into said game apparatus;

means for detecting the amount of game play media in said tray;

automatic taking-in control means for instructing said taking-in device to take in overflowing game play media, if said game play media detection means determines that the amount of game play media in said tray has exceeded a predetermined upper limit;

count storage means for storing the number of game play media not contained in said tray and held in said game apparatus;

means for adding the number of game play media taken in by said taking-in device to a count in said count storage means;

means for rewriting an operation result of said count addition means into said count storage means as a new count;

an adjustment switch for specifying the end of game playing and an adjustment;

a dispenser and printer for writing transferred remaining amount data and remaining count data onto a recording medium stored inside of said game apparatus in a predetermined format;

adjustment control means for instructing said taking-in device to take in all game play media in said tray, when said adjustment switch is operated;

adjustment data transmission means for reading the amount stored in said remaining amount storage means and the count stored in said count storage means and transmitting the read data to said dispenser as the remaining amount data and the remaining count data, upon completion of taking in the game play media in response to the instruction of said adjustment control means; and dispensing control means for instructing said dispenser to write the data onto the recording medium and dispense the recording medium, after the data transmission by said adjustment data transmission means is completed, wherein said prize exchanger of said game system reads the remaining amount data or remaining count data on said recording medium, returns the remaining amount of money, and pays a prize to the player in response to the remaining count.

17. A game apparatus having a game machine main unit for enabling a player to execute games with game play media, the cost to the player of executing a game being a predetermined amount wherein the improvement comprises:

a game play media dispenser responsive to a dispensing instruction for dispensing a specified number of game play media outside said game apparatus;

a validator having a slot for receiving a currency denominated bill and determining that the amount of the denomination of the bill received through the slot exceeds said predetermined amount;

a loan switch to specify, in accordance with said predetermined game execution cost amount, a loan amount to be spent to borrow game play media;

remaining amount management means for managing a remaining amount, said remaining amount management means subtracting a loan amount specified with said loan switch from the received amount determined by said validator to obtain said remaining amount;

a remaining amount display section for displaying the remaining amount managed by said remaining amount management means;

loan control means for instructing said game play media dispenser to dispense game play media in a number corresponding to the loan amount specified with said loan switch;

an adjustment switch for specifying the end of game playing and making an adjustment; and a dispenser for recording, upon receipt of information of the remaining amount managed by said remaining amount management means at the end of game playing, the information on a provided recording medium and dispensing the recording medium.

18. The game apparatus as claimed in claim 17 wherein:

said loan control means instructs said game play media dispenser to dispense game play media in a number corresponding to the loan amount determined by said loan switch within the limit of the remaining amount managed by said remaining amount management means.

19. The game apparatus as claimed in claim 18 further including:

a tray for holding game play media to be used to play games, said game machine main unit executing games with the game play media in said tray and outputting a winning signal to pay out game play media for a winning game play if a given condition is satisfied when a game is being played.

20. The game apparatus as claimed in claim 19 further including:

win control means responsive to the winning signal output from said game machine main unit for a winning game play for instructing said game play media dispenser to dispense as many game play media as the number indicated by the winning signal.

* * * * *